US008376065B2

(12) United States Patent
Teodorescu et al.

(10) Patent No.: US 8,376,065 B2
(45) Date of Patent: Feb. 19, 2013

(54) MONITORING DRILLING PERFORMANCE IN A SUB-BASED UNIT

(75) Inventors: Sorin G. Teodorescu, The Woodlands, TX (US); Eric C. Sullivan, Houston, TX (US); Matthew Meiners, Conroe, TX (US); John G. Evans, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 400 days.

(21) Appl. No.: 12/559,012

(22) Filed: Sep. 14, 2009

(65) Prior Publication Data

US 2010/0032210 A1 Feb. 11, 2010

Related U.S. Application Data

(63) Continuation-in-part of application No. 11/146,934, filed on Jun. 7, 2005, now Pat. No. 7,604,072.

(51) Int. Cl.
*E21B 47/01* (2012.01)

(52) U.S. Cl. ..... 175/40; 73/152.59

(58) Field of Classification Search ..... 175/45, 175/40, 50, 327; 73/152.48, 152.59
See application file for complete search history.

(56) References Cited

U.S. PATENT DOCUMENTS

| | | | |
|---|---|---|---|
| 2,507,351 | A | 5/1950 | Scherbatskoy |
| 4,884,071 | A | 11/1989 | Howard |
| 4,958,517 | A | 9/1990 | Maron |
| 5,012,412 | A | 4/1991 | Helm |
| 5,129,471 | A | 7/1992 | Maurstad et al. |
| 5,160,925 | A | 11/1992 | Dailey et al. |
| 5,415,030 | A | 5/1995 | Jogi et al. |
| 5,448,227 | A | 9/1995 | Orban et al. |
| 5,475,309 | A | 12/1995 | Hong et al. |
| 5,493,288 | A | 2/1996 | Henneuse |
| 5,553,678 | A | 9/1996 | Barr et al. |
| 5,720,355 | A | 2/1998 | Lamine et al. |
| 5,813,480 | A | 9/1998 | Zaleski, Jr. et al. |
| 5,842,149 | A | 11/1998 | Harrell et al. |
| 5,864,058 | A | 1/1999 | Chen |
| 6,021,377 | A | 2/2000 | Dubinsky et al. |
| 6,057,784 | A | 5/2000 | Schaaf et al. |
| 6,150,822 | A | 11/2000 | Hong et al. |
| 6,176,323 | B1 | 1/2001 | Weirich et al. |
| 6,206,108 | B1 | 3/2001 | MacDonald et al. |
| 6,230,822 | B1 | 5/2001 | Sullivan et al. |
| 6,233,524 | B1 | 5/2001 | Harrell et al. |
| 6,419,032 | B1 | 7/2002 | Sullivan et al. |
| 6,540,033 | B1 | 4/2003 | Sullivan et al. |
| 6,543,312 | B2 | 4/2003 | Sullivan et al. |
| 6,564,883 | B2 | 5/2003 | Fredericks et al. |
| 6,571,886 | B1 | 6/2003 | Sullivan et al. |

(Continued)

FOREIGN PATENT DOCUMENTS

GB 2395971 A 6/2004

OTHER PUBLICATIONS

Dateline Los Almos, a Monthly Publication of Los Almos National Laboratory, January Issue 1997, pp. 1-8.

(Continued)

*Primary Examiner* — Daniel P Stephenson
(74) *Attorney, Agent, or Firm* — Cantor Colburn LLP

(57) ABSTRACT

In one aspect, a removable module or sub is provided for use in drilling a wellbore, which sub in one embodiment may include a body having a pin end and a box end configured for coupling between two members of a drill string, the body having a bore therethrough for flow of a fluid, and a sensor disposed in a pressure-sealed chamber in one of the pin end and the box end and configured to provide measurements relating to a downhole condition.

19 Claims, 4 Drawing Sheets

U.S. PATENT DOCUMENTS

| | | | |
|---|---|---|---|
| 6,626,251 | B1 | 9/2003 | Sullivan et al. |
| 6,648,082 | B2 | 11/2003 | Schultz et al. |
| 6,651,496 | B2 | 11/2003 | Van Steenwyk et al. |
| 6,668,465 | B2 | 12/2003 | Noureldin et al. |
| 6,672,409 | B1 | 1/2004 | Dock et al. |
| 6,681,633 | B2 | 1/2004 | Schultz et al. |
| 6,691,802 | B2 | 2/2004 | Schultz et al. |
| 6,691,804 | B2 | 2/2004 | Harrison |
| 6,698,536 | B2 | 3/2004 | Moran et al. |
| 6,712,160 | B1 | 3/2004 | Schultz et al. |
| 6,722,450 | B2 | 4/2004 | Schultz et al. |
| 6,742,604 | B2 | 6/2004 | Brazil et al. |
| 6,769,497 | B2 | 8/2004 | Dubinsky et al. |
| 6,816,788 | B2 | 11/2004 | Van Steenwyk et al. |
| 6,817,425 | B2 | 11/2004 | Schultz et al. |
| 6,820,702 | B2 | 11/2004 | Niedermayr et al. |
| 6,837,314 | B2 | 1/2005 | Krueger et al. |
| 6,850,068 | B2 | 2/2005 | Chemali et al. |
| 6,892,812 | B2 | 5/2005 | Niedermayr et al. |
| 6,896,055 | B2 | 5/2005 | Koithan |
| 7,017,662 | B2 | 3/2006 | Schultz et al. |
| 7,046,165 | B2 | 5/2006 | Beique et al. |
| 7,058,512 | B2 | 6/2006 | Downton |
| 7,066,280 | B2 | 6/2006 | Sullivan et al. |
| 7,207,215 | B2 | 4/2007 | Spross et al. |
| 7,278,499 | B2 | 10/2007 | Richert et al. |
| 7,308,937 | B2 | 12/2007 | Radford et al. |
| 7,350,568 | B2 | 4/2008 | Mandal et al. |
| 7,387,177 | B2 | 6/2008 | Zahradnik et al. |
| 7,497,276 | B2 | 3/2009 | Pastusek et al. |
| 7,506,695 | B2 | 3/2009 | Pastusek et al. |
| 7,510,026 | B2 | 3/2009 | Pastusek et al. |
| 7,555,391 | B2 | 6/2009 | Gleitman |
| 2001/0042643 | A1 | 11/2001 | Krueger et al. |
| 2001/0054514 | A1 | 12/2001 | Sullivan et al. |
| 2003/0130846 | A1 | 7/2003 | King |
| 2004/0050590 | A1 | 3/2004 | Pirovolou et al. |
| 2004/0069539 | A1 | 4/2004 | Sullivan et al. |
| 2004/0112640 | A1 | 6/2004 | Hay et al. |
| 2004/0124012 | A1 | 7/2004 | Dunlop et al. |
| 2004/0168827 | A1 | 9/2004 | Jeffryes |
| 2004/0222018 | A1 | 11/2004 | Sullivan et al. |
| 2005/0268476 | A1 | 12/2005 | Illfelder |
| 2005/0283315 | A1 | 12/2005 | Haugland |
| 2006/0006000 | A1 | 1/2006 | Weston et al. |
| 2006/0248735 | A1 | 11/2006 | Haugland |
| 2006/0260843 | A1 | 11/2006 | Cobern |
| 2006/0272859 | A1 | 12/2006 | Pastusek et al. |
| 2007/0017705 | A1 | 1/2007 | Lasater |
| 2008/0060848 | A1 | 3/2008 | Pastusek et al. |
| 2008/0065331 | A1 | 3/2008 | Pastusek et al. |
| 2008/0066959 | A1 | 3/2008 | Pastusek et al. |

OTHER PUBLICATIONS

Semiconductor-Based Radiation Detectors, http://sensors.lbl.gov/sn_semi.html, pp. 1-5.

NETL: Oil & Natural Gas Projects, Harsh-Environment Solid-State Gamma Detector for Down-hole Gas and Oil Exploration, http://www.netl.doe.gov/technologies/oil-gas/NaturalGas/Projects_n/ . . . , pp. 1-5.

XRF Corporation, About CZT Detectors, http://xrfcorp.com/technology/about_czt_detectors.html, 1 sheet.

S. Sinanovic et al.; "Data Communication Along the Drill String Using Acoustic Waves," IEEE, ICASSP 2004, pp. IV-909-IV-912.

R. L. Schultz et al.; "Oilwell Drillbit Failure Detection Using Remote Acoustic Sensing," Proceedings of the American Control Conference, Anchorage, AK, May 8-10, 2002, pp. 2603-2608.

F. N. Trofimenkoff et al.; "Characterization of EM Downhole-to-Surface Communication Links," IEEE Transaction on Geoscience and Remote Sensing, vol. 38, No. 6, Nov. 2000, pp. 2539-2548.

A. Leseultre et al.; "An Instrumented Bit: A necessary step to the intelligent BHA," IADC/SPE 39341, 1998 IADC/SPE Drilling Conference, Dallas, Texas, Mar. 3-6, 1998, pp. 457-463.

A. Hoefel et al.; "Subsurface Telemetry in Conductive Medium for Remote Sensors," IEEE, 2003, pp. 227-230.

K. Ramamurthi et al.; "Real Time Expert System for Predictive Diagnostics and Control of Drilling Operation," IEEE, 1990, pp. 62-69.

J. M. Carcione et al.; "A Telegrapher Equation for Electric Telemetering in Drill Strings," IEEE Transaction on Geoscience and Remote Sensing, vol. 40, No. 5, May 2002, pp. 1047-1053.

J. T. Finger et al.; Development of a System for Diagnostic-While-Drilling (DWD), SPE/IADC 79884, SPE/IADC Drilling Conferences, Amsterdam, The Netherlands, Feb. 19-21, 2003, pp. 1-9.

J. C. Goswami et al.; "A Robust Technique for Well-Lot Data Inversion," IEEE Transaction on Antennas and Propagation, vol. 52, No. 3, Mar. 2004, pp. 717-724.

MONITORING DRILLING PERFORMANCE IN A SUB-BASED UNIT

CROSS-REFERENCES TO RELATED APPLICATIONS

This application claims priority as a continuation-in-part of U.S. patent application Ser. No. 11/146,934 filed on Jun. 7, 2005, which is incorporated herein by reference in entirety.

BACKGROUND OF THE INVENTION

1. Field of the Disclosure

This disclosure relates generally to apparatus for use in a wellbore that includes sensors in a module (or "sub") for estimating parameters of interest of a system, such as a drilling system.

2. Background of the Art

Oil wells (boreholes) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations (drilling parameters), behavior of the BHA (BHA parameters) and formation surrounding the wellbore being drilled (formation parameters). Drilling parameters include weight-on-bit ("WOB"), rotational speed (revolutions per minute or "RPM") of the drill bit and BHA, rate of penetration ("ROP") of the drill bit into the formation, and flow rate of the drilling fluid through the drill string. The BHA parameters typically include torque, whirl, vibrations, bending moments and stick-slip. Formation parameters include various formation characteristics, such as resistivity, porosity and permeability, etc.

Various sensors are utilized in the drill string to provide measurement of selected parameters on interest. Such sensors are typically placed at individual location, such as in the BHA and/or drill pipe. U.S. patent application Ser. No. 11/146,934 filed on Jun. 7, 2005, having the same assignee as the present disclosure discloses a plug-in sensor and electronics module for placement in a pin section of the drill bit. The electronics is located relatively close to the sensors and thus allows processing of signals without significant attenuation of the signals detected by the sensors in the module. The present disclosure is directed to a module containing sensors and electronics configured to estimate a variety of downhole parameters that may be disposed in the BHA and/or at one or more locations along the drillstring.

SUMMARY

In one aspect, a removable module or sub is provided for use in drilling a wellbore, which sub in one embodiment may include: a body having a central bore therethrough; a pin end having an external thread configured to be coupled to one of another sub and a drill pipe; a box end having an internal thread configured to be coupled to one of another sub, and a drill pipe; and at least one sensor configured to make a measurement indicative of at least one of (a) a downhole condition, and (b) a property of the earth formation, wherein the sensor is disposed in a pressure-sealed chamber in at least one of the box end and the pin end.

In another aspect, a method is provided that in one embodiment may include: conveying a drill string including a tubular and a bottomhole assembly (BHA) including a drill bit at end thereof; providing a removable sub at a selected location in the drill string, wherein the sub includes a sensor module including at least one sensor configured to make measurements indicative of at least one of a downhole condition, the at least one sensor is pressure sealed in a chamber, the removable sub including a bore extending therethrough for flow of a fluid therethrough.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE FIGURES

For detailed understanding of the present invention, references should be made to the following detailed description of the invention, taken in conjunction with the accompanying drawings, in which like elements have been given like numerals and wherein.

DETAILED DESCRIPTION OF THE DISCLOSURE

Figure 1:
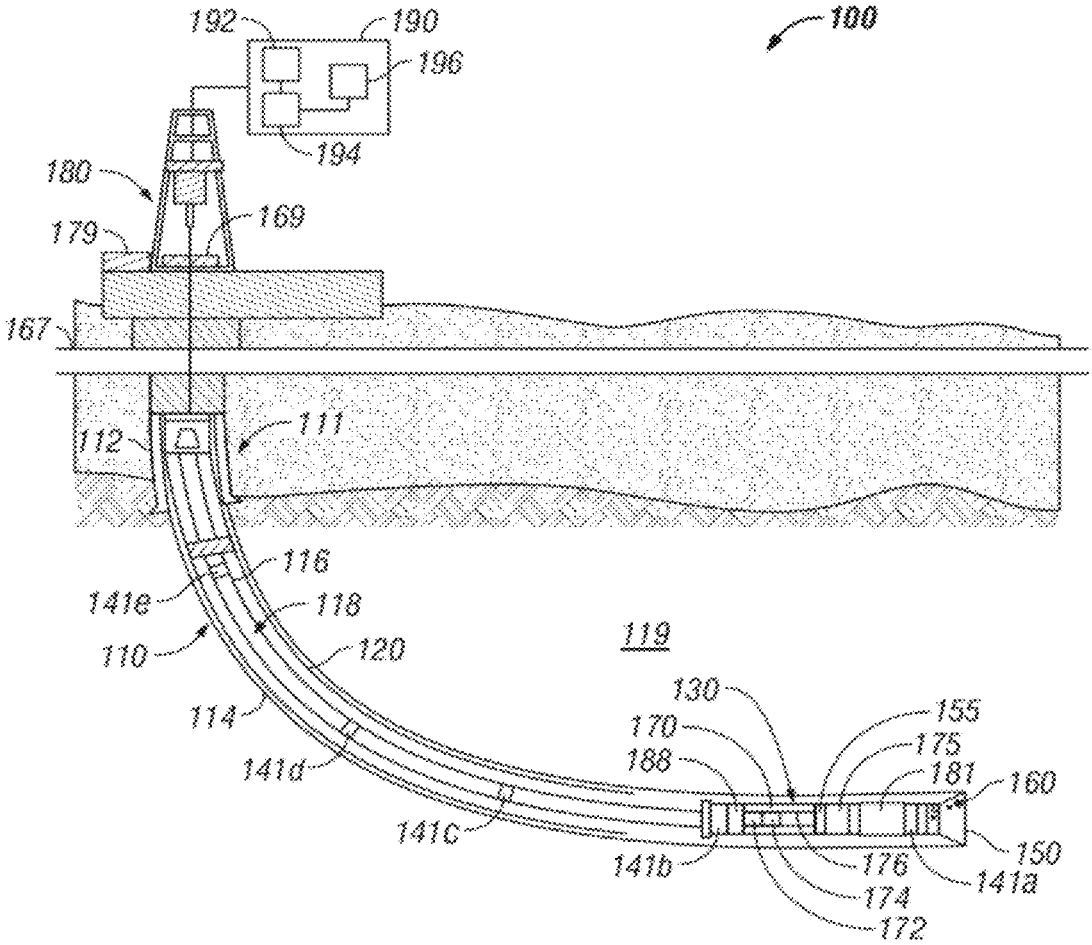
FIG. 1 is a schematic diagram of an exemplary drilling system that includes a drill string that contains one or more subs, according to one embodiment of the disclosure.

FIG. 1 is a schematic diagram of an exemplary drilling system 100 that may utilize apparatus and methods disclosed herein for drilling wellbores. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 (also referred to as the bottomhole assembly or "BHA") at its bottom end. The tubular member 116 may be made up by joining drill pipe sections or it may be coiled tubing. A drill bit 150 attached to the bottom end of the BHA 130 disintegrates the rock formation to drill the wellbore 110 of a selected diameter in the formation 119. The terms wellbore and borehole are used herein as synonyms.

The drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with offshore rigs. A rotary table 169 or a top drive (not shown) at the surface may be used to rotate the drill string 118, drilling assembly 130 and the drill bit 150 to drill the wellbore 110. A drilling motor 155 (also referred to as "mud motor") may also be provided in the BHA to rotate the drill bit 150 alone or to motor rotation on the drill string rotation. A control unit (or a surface controller) 190 at the surface 167, which may be a computer-based system may be utilized for receiving and processing data transmitted by the sensors in the drill bit 150 and sensors in the BHA 130, and for controlling selected operations of the various devices and sensors in the drilling assembly 130. The surface controller 190, in one embodiment, may include a processor 192, a data storage device (or a computer-readable medium) 194 for storing data and computer programs 196. The data storage device 194 may be any suitable device, including, but not limited to, a read-only memory (ROM), a random-access memory (RAM), a flash memory, a magnetic tape, a hard disk and an optical disk. To drill wellbore 110, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall of the wellbore 110.

Still referring to FIG. 1, the drill bit 150 may include a sensor and electronics module 160 estimating one or more parameters relating to the drill bit 150 as described in more detail in reference to FIGS. 2-4. The drilling assembly 130 may further include one or more downhole sensors (also referred to as the measurement-while-drilling (MWD) or logging-while-drilling (LWD) sensors (collectively designated by numeral 175), and at least one control unit (or controller) 170 for processing data received from the MWD sensors 175 and/or the sensors in the drill bit 150. The controller 170 may include a processor 172, such as a microprocessor, a data storage device 174 and a program 176 for use by the processor 172 to process downhole data and to communicate data with the surface controller 190 via a two-way telemetry unit 188. The data storage device may be any suitable memory device, including, but not limited to, a read-only memory (ROM), random access memory (RAM), Flash memory and disk.

Also shown in FIG. 1 is a sub 141*a*. This sub 141*a* is described below with reference to FIGS. 2-4. The sub 141*a* may include sensors for measuring a variety of parameters, including, but not limited to, RPM, WOB, vibration, torque, whirl, bending, acceleration, oscillation, stick-slip, and bit bounce. The parameters measured by sensors in the sub 141*a* are referred to herein as downhole conditions or downhole parameters. In the location shown, the sub 141*a* may be used to estimate downhole parameters near the bottom of the BHA 130. The sensors in the module 160 may be used to measure the downhole parameters at the drill bit 150.

An additional sub 141*b* may be provided in the BHA 130. In one embodiment of the disclosure, at least one sub, such as sub 141*b*, may be positioned near a stabilizer schematically represented by 181. Additional subs such as subs 141*c*, 141*d* and 141*e* may be placed spaced apart at various selected locations along the drillstring 118. For example, the subs may be placed every $10^{th}$ pipe junction or $15^{th}$ pipe junction, etc. Certain details and the use of the subs in the drilling system 100 are discussed below in reference to FIGS. 2-3B.

Figure 2A:
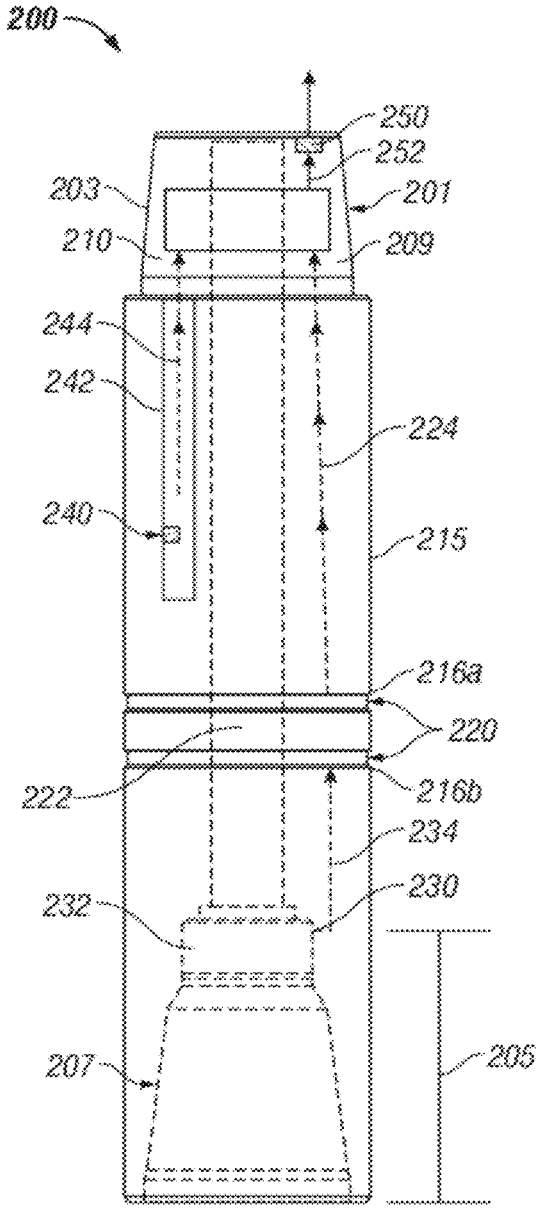
FIG. 2A is a view illustrating an exemplary configuration of a sub for use in a drilling system, such as shown in FIG. 1, according to one embodiment of the disclosure.
Figure 2B:
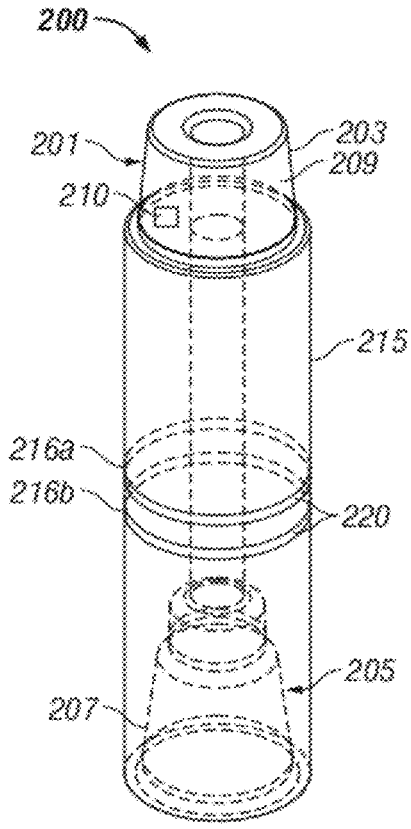
FIG. 2B is an isometric view of the sub shown in FIG. 2A, depicting certain internal details for housing a module containing sensors and electronics, according to one embodiment of the disclosure.

FIG. 2A is a view of an exemplary sub 200 showing certain internal details of the sub configured to house sensors and electronics and connections for coupling the sub at any suitable location in the drill string shown in FIG. 1, according to one embodiment of the disclosure. FIG. 2B is an isometric view of the sub shown in FIG. 2A, depicting certain internal details for housing a module containing sensors and electronics, according to one embodiment of the disclosure. Referring to FIGS. 2A and 2B, the sub 200 is shown to include two ends, a pin end (or section) 201 and a box end (or section) 205. The box end 205 includes internal threads 207 for coupling to pin end of an other tool or device in the drill string, such as the drill bit 150, a section of the BHA 130 or a pipe section in the drilling tubular 116 (FIG. 1). The pin end 201 is provided with external threads 203 for coupling to a box end of another device. Any other connection ends may be used for the sub 200 for the purposes of this disclosure. The sub 200 also includes a flow channel 203 for flow of the drilling mud therethrough. Such a configuration enables the sub 200 to be coupled between any two devices of a drill string and allows the drilling fluid to flow therethrough during drilling of oil and gas wellbores. In one aspect, the pin section 201 of the sub 200 may include a recess 209 configured to sealingly house a sensor and electronic package 210, as described in more detail in reference to FIGS. 3A and 3B. In another aspect a sensor and electronics module 220 may be placed within a shank section 215 of the sub 200. The module 220 may be a separate device that is connected to two ends 216*a* and 216*b* of the shank 215. A bore 222 is provided in the module 220 to allow the flow of the drilling fluid through the sub 200.

Still referring to FIGS. 2A and 2B, in another configuration, a sensor and electronics module 230 may be placed in a recessed section 232 provided in the box section 205 of the sub 200. In some applications, it may be desirable to place sensors at other locations in the sub 200. For example certain sensors 240 may be placed in a recess 242 made longitudinally along the shank section 215 of the sub 200. Such sensors may include torque and weight sensors or differential pressure sensors, etc. In each of the configurations described herein, sensor data may be processed by the electronic circuits housed in a module in the sub 200. For example, the data from the sensors in the module may be processed by a processor in the module 210, the data from sensors in module 220 may be processed by a processor in the module 210 and/or in module 220, data from sensors in module 230 may be processed by a processor in modules 230, 220 and/or 210. Data from sensors 240 may be communicated via communication links 244 to the processor in module 210 for processing. Also, data from module 230 may be sent to a device outside the sub via communication links 234 and from module 220 via links 224. Data from the sub 200 may be sent to other devices via a connection or device 250, which connection may include, but is not limited to, electrical or electromagnetic couplings and acoustic transducers.

Figure 3A:
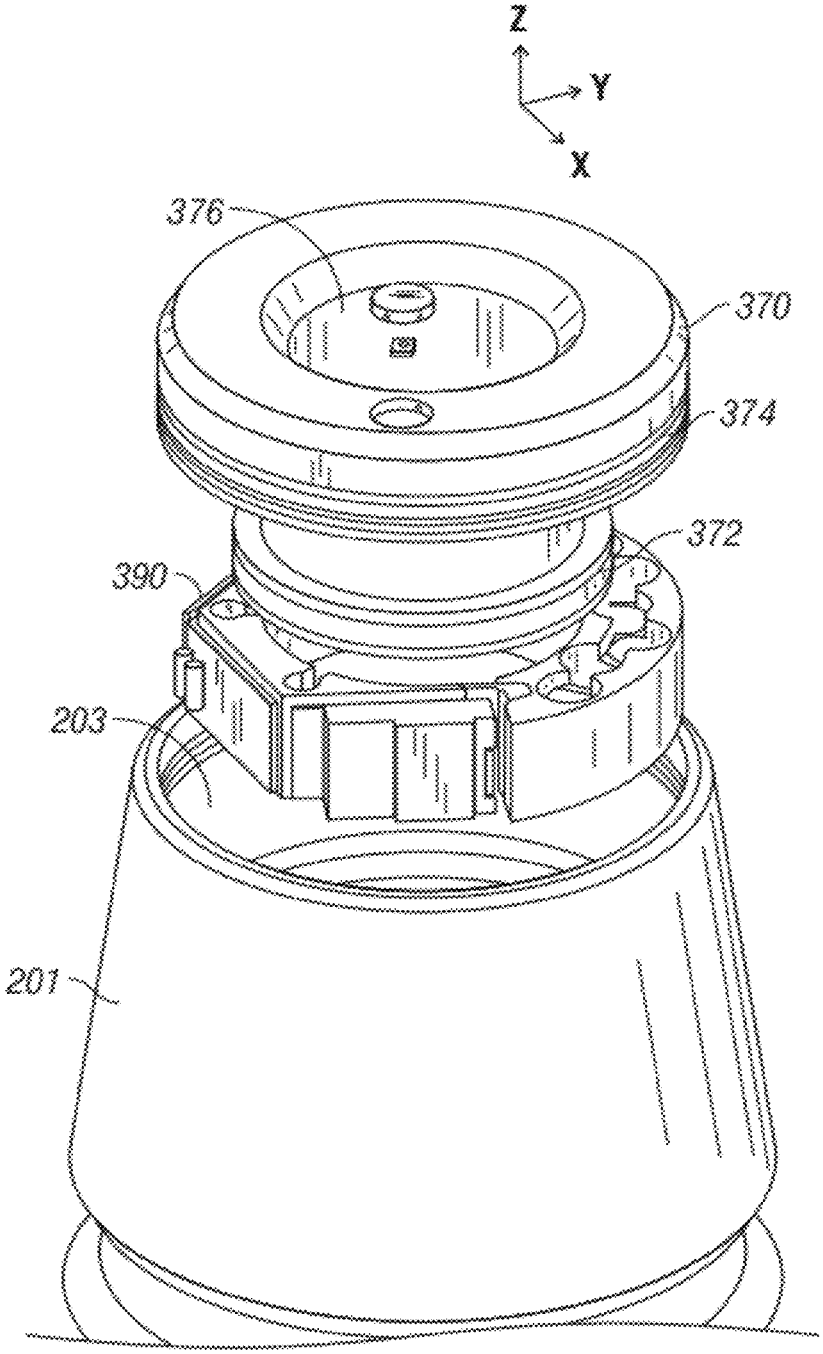
FIG. 3A is a perspective view of a sensor and electronics module placed in the pin end of the sub shown in FIG. 2A and FIG. 2B, according to one embodiment of the disclosure.
Figure 3B:
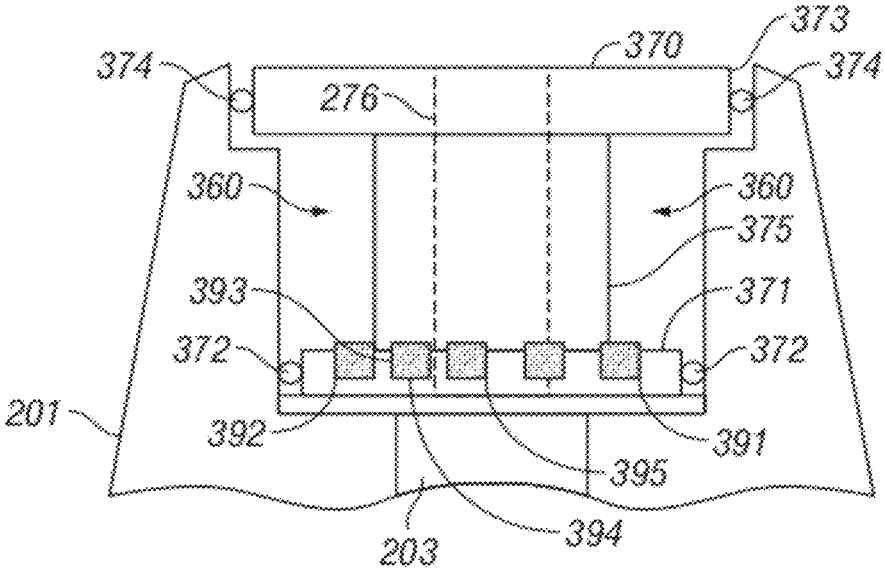
FIG. 3B is a sectional view of the pin end of the sub showing placement of the sensor and electronics module therein, according to one embodiment of the disclosure.

FIGS. 3A and 3B show an exemplary module at the pin end, according to one embodiment of the disclosure. Shown in FIGS. 3A and 3B is a sensor and electronics module 390 removed from the pin end 201. The module includes an end-cap 370. The pin end 310 includes a central bore 203 formed through the longitudinal axis of the pin end 201. In the present disclosure, at least a portion of the central bore 203 includes a diameter sufficient for accepting the electronics module 390 configured in a substantially annular ring, without affecting the structural integrity of the pin end 201. Thus, the electronics module 390 may be placed in the central bore 303, about the end-cap 370, which extends through the inside diameter of the annular ring of the electronics module 390. This creates a fluid-tight annular chamber 360 with the wall of the central bore 203 and seals the electronics module 390 in place within the pin end 201.

The end-cap 370 includes a cap bore 376 formed therethrough, such that the drilling mud may flow through the end cap, through the central bore 203 of the pin end 201 into the body of the sub 200. In addition, the end-cap 370 includes a first flange 371 including a first sealing ring 372, near the lower end of the end-cap 370, and a second flange 373 including a second sealing ring 374, near the upper end of the end-cap 370.

FIG. 3B is a cross-sectional view of the end-cap 370 disposed in the pin end 201 without the electronics module 390, illustrating the annular chamber 360 formed between the first flange 371, the second flange 373, the end-cap body 375, and the walls of the central bore 203. The first sealing ring 372 and the second sealing ring 374 form a protective, fluid-tight seal between the end-cap 370 and the wall of the central bore 203 to protect the electronics module 390 from adverse environmental conditions. The protective seal formed by the first sealing ring 373 and the second sealing ring 374 may also be configured to maintain the annular chamber 360 at approximately atmospheric pressure.

In the exemplary embodiment shown in FIGS. 3A, 3B, the first sealing ring 372 and the second sealing ring 374 are formed of a material suitable for use in a high-pressure, high-temperature environment, such as, for example, a Hydrogenated Nitrile Butadiene Rubber (HNBR) O-ring in combination with a PEEK back-up ring. In addition, the end-cap 370 may be secured to the pin end 201 with a number of connection mechanisms, such as a press-fit using sealing rings 372 and 374, a threaded connection, an epoxy connection, a shape-memory retainer, welded, and brazed. It will be recognized by those of ordinary skill in the art that the end-cap 370 may be held in place quite firmly by a relatively simple connection mechanism due to differential pressure and downward mud flow during drilling operations.

An electronics module 390 configured as shown in the exemplary embodiment of FIG. 3A may be configured as a flex-circuit board, which enables the formation of the electronics module 390 into the annular ring that can be disposed about the end-cap 370 and into the central bore 301. The sensors in the module are designated collectively by numeral 391, which sensors may include any desired sensors, including, but not limited to, accelerometers, gyroscopes, pressure sensors, temperature sensors, torque and weight sensors, and bending moment sensors. Module 390 further may include a controller 392 that contains a processor 393 (such as microprocessor), a storage device 394 (such as a solid-state memory) and data and programmed instructions 395 for use by the processor 392 to process sensor data. Other electronic circuits and components used by the controller are designated by numeral 398. The sensor and electronics modules 320 and 330 may be configured in the manner described in reference to module 310 or in any other suitable manner. The sensors and electronics in such modules may be sealingly placed in the sub at the surface so that the sensors and electronics will remain substantially at ambient pressure when the module is used in a wellbore.

The sub 200 enables monitoring of drilling parameters at numerous locations in the BHA and along the drillstring. The measurements of drilling parameters may be used by the processor 172 to identify undesirable behavior of the BHA 130. Remedial action in the form of altering WOB, RPM and torque can be directed by either the downhole processor or from the surface based on telemetered data sent uphole by telemetry unit 188. Vibration measurements near the stabilizer can suggest alteration of the force on the stabilizer ribs.

The subs 141*c*, 141*d*, 141*e* along the drillstring may be battery powered. Alternatively, a wired drill-pipe may be used to power the electronics modules on the subs. These measurements are useful in analyzing the vibration of the drill string. Vibrations of a drilling tool assembly are difficult to predict because several forces may combine to produce the various modes of vibration. Models for simulating the response of an entire drilling tool assembly including a drill bit interacting with formation in a drilling environment have not been available. Drilling tool assembly vibrations are generally undesirable, not only because they are difficult to predict, but also because the vibrations can significantly affect the instantaneous force applied on the drill bit. This can result in the drill bit not operating as expected.

For example, vibrations can result in off-centered drilling, slower rates of penetration, excessive wear of the cutting elements, or premature failure of the cutting elements and the drill bit. Lateral vibration of the drilling tool assembly may be a result of radial force imbalances, mass imbalance, and drill bit/formation interaction, among other things. Lateral vibration results in poor drilling tool assembly performance, which may result in over-gage hole-drilling, out-of-round (or lobed) wellbores and premature failure of the cutting elements and drill bit bearings.

The measurements made by these distributed sensors during drilling of deviated boreholes may be used to identify nodal locations along the drillstring where vibration is minimal and antinodal locations along the drillstring where vibrations are greater than selected limits. Nodal locations may be diagnostic of sticking of the drillstring in the wellbore. Knowledge of vibration at antinodal locations enables a drilling operator to alter the drilling operation to control vibrations such that they do not exceed the desired limits. In this regard, the acceleration and/or strain measurements made by the distributed subs may be input to a suitable drillstring vibration modeling program for analysis. SPE 59235 of Heisig et al. (which is incorporated herein by reference in entirety) discloses different methods for analysis of lateral drillstring vibrations in extended reach wells. These include an analytic solution, a linear finite element model and a non-linear finite element model. The assumption in Heisig is that the drillbit is at an antinode and vibration analysis is carried out for a fixed length of pipe, based on the assumption that the other end of the pipe is a node. The modeling program used in Heisig may be used for modeling drillstring vibrations with nodes and antinodes identified by the distributed sensors. Another modeling program that may be used for the purposes of this disclosure is discussed in SPE59236 of Schmalhorst et al, which is incorporated herein by reference in entirety. This modeling program takes the mud flow into account. The effect of changing parameters, such as WOB and RPM, may be modeled in real time, which enables an operator to initiate remedial actions in real time.

In another aspect, the measurements made using the sensors in the subs described herein may be used to identify a dysfunction of the drillstring, and to estimate the WOB and torque at specific locations along the drillstring. A dysfunction of the drillstring is defined as a drill string parameter outside a defined or selected limit and may include, but is not limited to, vibration, displacement, sticking, whirl, reverse spin, bending and strain. In addition, the measurements and processed data may be stored on a suitable memory in the electronics module and analyzed upon tripping out of the borehole.

Alternatively, the data may be processed by a downhole and/or surface processor. Implicit in the control and processing of the data is the use of a computer program implemented on a suitable machine readable medium that enables the processor to perform the control and processing. The machine-readable medium may include ROMs, EPROMs, EAROMs, flash memories and optical disks.

Thus, in one aspect an apparatus for use in a borehole is disclosed, which in one embodiment may include: a BHA configured to be conveyed on a drilling tubular into a borehole, the BHA including a drill bit configured to drill an earth formation; and at least one removable sub in the drill string that includes a body having a pin end, a box end, and at least one sensor configured to make a measurement indicative of a downhole condition (or a "characteristic," a "parameter" or a "parameter of interest"), the at least one sensor being disposed in a pressure-sealed chamber in the body. In one aspect, the at least one sub includes a processor configured to process signals from the at least one sensor. In another aspect, the pressure-sealed chamber may be formed or disposed in the pin end or the box end. The downhole condition may relate to one or more of: (i) acceleration, (ii) rotational speed (RPM), (iii) weight-on-bit (WOB), (iv) torque, (v) vibration, (vi) oscillation, (vii) acceleration, (viii) stick-slip, (xi) whirl, (x) strain, (xi) bending, (xii) temperature, and (xiii) pressure. In another embodiment, one or more additional removable subs may be disposed at selected locations in the drill string, wherein each additional sub includes an additional sensor configured to provide measurements indicative of the downhole condition at their respective selected locations. In another aspect, each sub may include a processor configured to process measurements from the sensor or sensors using one or more computer models to determine or identify a drilling dysfunction. The processor may further be configured to alter a drilling parameter in response to the identified dysfunction. In one configuration the pin end may include external threads and the box end may include internal threads, each end configured to be coupled to at least one of a (i) drilling tubular; (ii) sub; (iii) drill bit, and (iv) tool in the BHA. Data to and/or from the sub may be sent via a suitable communication link including, but not limited to, an electromagnetic coupling, an acoustic transducer, a slip ring, and a wired pipe.

In another aspect, a method for estimating a downhole condition is provided, which in one embodiment may include: providing a removable sub at a selected location in a drilling apparatus, wherein the removable sub includes a sensor in a pressure-sealed chamber in the removable sub, the removable sub further including a bore for flow of a fluid therethrough; making measurements using the sensor indicative of the downhole condition; and processing the measurements from the sensor to estimate the downhole condition. The measurements may be made of any suitable characteristic of a drilling apparatus, borehole and/or formation, including but not limited to: (i) acceleration, (ii) rotational speed (RPM), (iii) weight-on-bit (WOB), (iv) torque, (v) vibration, (vi) oscillation, (vii) acceleration, (viii) stick-slip, (ix) whirl, (x) strain, (xi) bending, (xii) temperature, and (xiii) pressure. The method may further include: processing the measurements from the sensor using a model to identify a drilling dysfunction; and altering a drilling parameter in response to the identified dysfunction. The data to and/or from the sub may be communicated via any suitable method, including, but not limited to, using: an electromagnetic coupling; an acoustic transducer; a slip ring; and a wired pipe. The method may further include: disposing at least one additional removable sub having an additional sensor on the drilling tubular at a elected location; and identifying the downhole condition using measurements from the additional sensor. In another aspect, the method may further include altering a drilling parameter in response to the identified downhole condition. In another aspect, as removable is disclosed, which in one embodiment may include: a body having a pin end and a box end each configured for coupling to a member of a drill string, the body having a bore therethrough for flow of a fluid; a sensor disposed in a pressure-sealed chamber in one of (i) the pin end; (ii) the box end, (iii) the sensor configured to provide measurements relating to a downhole condition, (iv) vibration, (v) oscillation, (vi) acceleration, (vii) stick-slip, (viii) whirl, (xi) strain, (x) bending, (xi) temperature, and (xii) pressure.

While the foregoing disclosure is directed to specific embodiments of the invention, various modifications will be apparent to those skilled in the art. It is intended that all variations within the scope and spirit of the appended claims be embraced by the foregoing disclosure.

The invention claimed is:

1. An apparatus for use in a wellbore, the apparatus comprising:

a bottomhole assembly (BHA) coupled to drilling tubular conveyable into the wellbore, the BHA including a drill bit configured to drill an earth formation; and at least one removable sub in the drill string, the sub including a body having a bore for flow of drilling fluid, a pin end, a box end, and at least one sensor configured to make a measurement indicative of a downhole condition, the at least one sensor being disposed in a pressure-sealed chamber in the body formed by a sealing element of an end-cap body in contact with an interior wall of the bore, the end-cap body having a longitudinal bore formed therethrough.

2. The apparatus of claim 1, wherein the at least one sub includes a processor configured to process signals from the at least one sensor.

3. The apparatus of claim 1, wherein the pressure-sealed chamber is one of: a chamber in the pin end and a chamber in the box end.

4. The apparatus of claim 1, wherein the downhole condition is one of: (i) acceleration, (ii) rotational speed (RPM), (iii) weight-on-bit (WOB), (iv) torque, (v) vibration, (vi) oscillation, (vii) acceleration, (viii) stick-slip, (xi) whirl, (x) strain, (xi) bending, (xii) temperature, and (xiii) pressure.

5. The apparatus of claim 1, wherein the at least one removable sub includes an additional sub disposed at a selected location on the drilling tubular, the additional sub including an additional sensor configured to provide additional measurements indicative of the downhole condition at the selected location.

6. The apparatus of claim 1 further comprising a processor configured to:

process measurements from the at least one sensor using a model to identify a drilling dysfunction; and alter a drilling parameter in response to the identified dysfunction.

7. The apparatus of claim 1, wherein:

the pin end includes external threads and the box end includes internal threads, each end configured to be coupled to at least one of a: (i) drilling tubular; (ii) sub; (iii) drill bit, and (iv) tool in the BHA.

8. The apparatus of claim 1 further comprising a communication link configured to communicate data using one of: an electromagnetic coupling; an acoustic transducer; a slip ring; and a wired pipe.

9. A method for estimating a downhole condition, the method comprising:

providing a removable sub at a selected location in a drilling apparatus, the removable sub including a bore for flow of a fluid therethrough, the removable sub further including a sensor in a pressure-sealed chamber formed by a sealing element in contact with an interior wall of the bore, the body having a longitudinal bore formed therethrough;

making measurements using the sensor indicative of a downhole condition; and and processing the measurements from the sensor to estimate the downhole condition.

10. The method of claim 9, wherein the pressure-sealed chamber is disposed at one of: a pin end of the sub and a box end of the sub.

11. The method of claim 9, wherein making the measurements comprises making measurements relating to one of: (i) acceleration, (ii) rotational speed (RPM), (iii) weight-on-bit (WOB), (iv) torque, (v) vibration, (vi) oscillation, (vii) acceleration, (viii) stick-slip, (ix) whirl, (x) strain, (xi) bending, (xii) temperature, and (xiii) pressure.

12. The method of claim 9 further comprising:

processing the measurements from the sensor using a model to identify a drilling dysfunction; and altering a drilling parameter in response to the identified dysfunction.

13. The method of claim 9 further comprising:

communicating data to and/or from the removable sub using one of: an electromagnetic coupling; an acoustic transducer; a slip ring; and a wired pipe.

14. The method of claim 9 further comprising:

disposing at least one additional removable sub having an additional sensor on the drilling tubular at a elected location; and identifying the downhole condition using measurements from the additional sensor.

15. The method of claim 14 further comprising altering a drilling parameter in response to the identified downhole condition.

16. The method of claim 14 further comprising providing power to the additional sub using at least one of: (i) a battery, and (ii) a wired pipe.

17. A sub for use in a drill string for drilling a wellbore, comprising:

a body having a pin end and a box end, each end configured for coupling to a member of a drill string, the body having a bore therethrough for flow of a fluid;

a sensor disposed in a pressure-sealed chamber in one of (i) the pin end; (ii) the box end, the sensor configured to provide measurements relating to a downhole condition, the pressure-sealed chamber being formed by a sealing element of an end-cap body in contact with an interior wall of the bore, the end-cap body having a longitudinal bore formed therethrough.

18. The sub of claim 17, wherein the measurements relate to one of: (i) acceleration, (ii) rotational speed (RPM), (iii) weight on bit (WOB), (iv) torque, (v) vibration, (vi) oscillation, (vii) acceleration, (viii) stick-slip, (ix) whirl, (x) strain, (xi) bending, (xii) temperature, and (xiii) pressure.

19. The sub of claim 17, wherein the pressure sealed chamber further comprises a processor configured to process data relating to the sensor measurements.

* * * * *